US009499930B2

(12) United States Patent
Miller et al.

(10) Patent No.: US 9,499,930 B2
(45) Date of Patent: Nov. 22, 2016

(54) ELEVATOR COVER ASSEMBLY

(71) Applicant: Harry Miller Co., Inc., Boston, MA (US)

(72) Inventors: Harry Miller, Weston, MA (US); Michael Frisch, Braintree, MA (US); Ray Metcalfe, Scarborough, CA (US)

(73) Assignee: Harry Miller Company, Boston, MA (US)

( * ) Notice: Subject to any disclaimer, the term of this patent is extended or adjusted under 35 U.S.C. 154(b) by 423 days.

(21) Appl. No.: 13/790,959

(22) Filed: Mar. 8, 2013

(65) Prior Publication Data

US 2014/0255639 A1 Sep. 11, 2014

(51) Int. Cl.

| | |
|---|---|
| ***A47H 23/04*** | (2006.01) |
| ***D06C 7/00*** | (2006.01) |
| ***A47H 1/18*** | (2006.01) |
| *A47H 23/02* | (2006.01) |

(52) U.S. Cl.

CPC *D06C 7/00* (2013.01); *A47H 1/18* (2013.01); *A47H 2023/025* (2013.01); *Y10T 24/51* (2015.01); *Y10T 156/1056* (2015.01); *Y10T 428/192* (2015.01)

(58) Field of Classification Search

CPC ..... Y10T 428/192
USPC ..... 428/58
See application file for complete search history.

(56) References Cited

U.S. PATENT DOCUMENTS 5,660,402 A * 8/1997 Jones et al. ..... 280/19

* cited by examiner

*Primary Examiner* — Brent O'Hern
(74) *Attorney, Agent, or Firm* — Lowe Graham Jones PLLC

(57) ABSTRACT

An elevator cover assembly having a cover pad and a trim with openings for receiving a hanging knob inside the elevator is disclosed. The trim is a separate piece attached to the elevator cover after openings are made in the trim. The trim slits formed therein are sized and positioned to receive hanging knobs. The trim is made of a flexible material that can be deformed to broaden the openings to more easily position the openings over the knobs.

13 Claims, 6 Drawing Sheets

ELEVATOR COVER ASSEMBLY

TECHNICAL FIELD OF THE INVENTION

The invention relates generally to a cover assembly for hanging against a surface to protect the surface, such as in an elevator to protect the walls of the elevator.

BACKGROUND OF THE INVENTION

Elevator pads are commonly used in elevators to protect the interior surfaces from scratching or other damage. The elevator pads can be attached to the interior walls of the elevator when a large or potentially damaging cargo is to be carried by the elevator, such as when a tenant in an apartment building moves in or out. Conventionally these elevator pads are clipped to the walls of the elevator or otherwise attached by a metal hanger or by another type of hardware. The pads include holes in the pad itself arranged at certain intervals along a top edge of the pad to attach to a peg or post in the elevator. However, this arrangement has significant disadvantages. For example, the spacing of the holes may not match with the spacing of the pegs in a given elevator installation. Making additional holes or other accommodations can be a costly process and may compromise the strength of the pad. Some elevator pads have buttonholes with stitching around the interior edges, which are time-consuming and expensive to manufacture. These configurations are not easily modifiable and may not fit a given installation of pegs. Making adjustments to the pegs themselves in the elevator is even more costly and difficult. Also, placing the holes in the pad itself may weaken the pad or cause it to tear at any spacing interval. Another problem is accommodating an installation with an irregular ceiling profile. Pads are generally produced with a straight top edge leaving the proprietor with the choice of modifying the pad somehow to accommodate the ceiling, or leaving a portion of the ceiling uncovered by the pad. Neither option is ideal. There is a need in the art for a more simple, more easily deployed elevator pad.

SUMMARY OF THE INVENTION

The present disclosure is generally directed to an elevator protection assembly including a substantially flat protective cover sufficiently thick and sturdy to protect an interior surface of an elevator, and a trim formed separately from the cover and attached to an edge of the cover. The trim has a first edge attached to an upper edge of the cover and a second edge extending beyond the upper edge of the cover. The assembly also includes a plurality of openings formed in the trim and configured to receive projections such as hooks extending from within elevator to hang the cover assembly within the elevator. The second edge of the trim extends beyond the edge of the cover a sufficient distance that the openings are positioned on the trim beyond the edge of the cover.

In some embodiments, the projection (or hook) includes a base, a stem protruding from the base, and a head coupled to the outer end of the stem. The base provides a stable support for the stem and is secured to a wall with a quick-curing permanent adhesive. The head is preferably slightly larger than the stem to maintain the elevator cover assembly on the projection.

In still other embodiments, the present disclosure is directed to a method of forming an elevator cover assembly. The method includes forming an elevator cover pad from a generally flat, protective sheet of material having sufficient resiliency and durability to protect an elevator wall from a predetermined amount of impact or abrasion. Trim is attached to an edge of the cover pad. Before attachment to the cover, the trim is formed separate from the cover from a woven synthetic material and is sized and positioned to support the cover pad in a desired orientation within the elevator. The method also includes forming a plurality of openings in the trim oriented to correspond to a plurality of projections within the elevator.

The cover may have an irregular profile, including one or more cover regions having a stepped or angled profile. The method further includes attaching the trim in segments to the cover regions at lengths corresponding to the length of the cover regions.

In yet other embodiments, the present disclosure is directed to a knob for use with an elevator wall cover. The knob has a base, a projection extending from the base a sufficient distance to provide support for the elevator wall cover, and an attachment mechanism coupled to the base. The attachment mechanism is configured to secure the base to an elevator wall to be protected by the elevator pad. The knob also includes a head at the outer end of the projection configured to hold the elevator cover on the knob.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
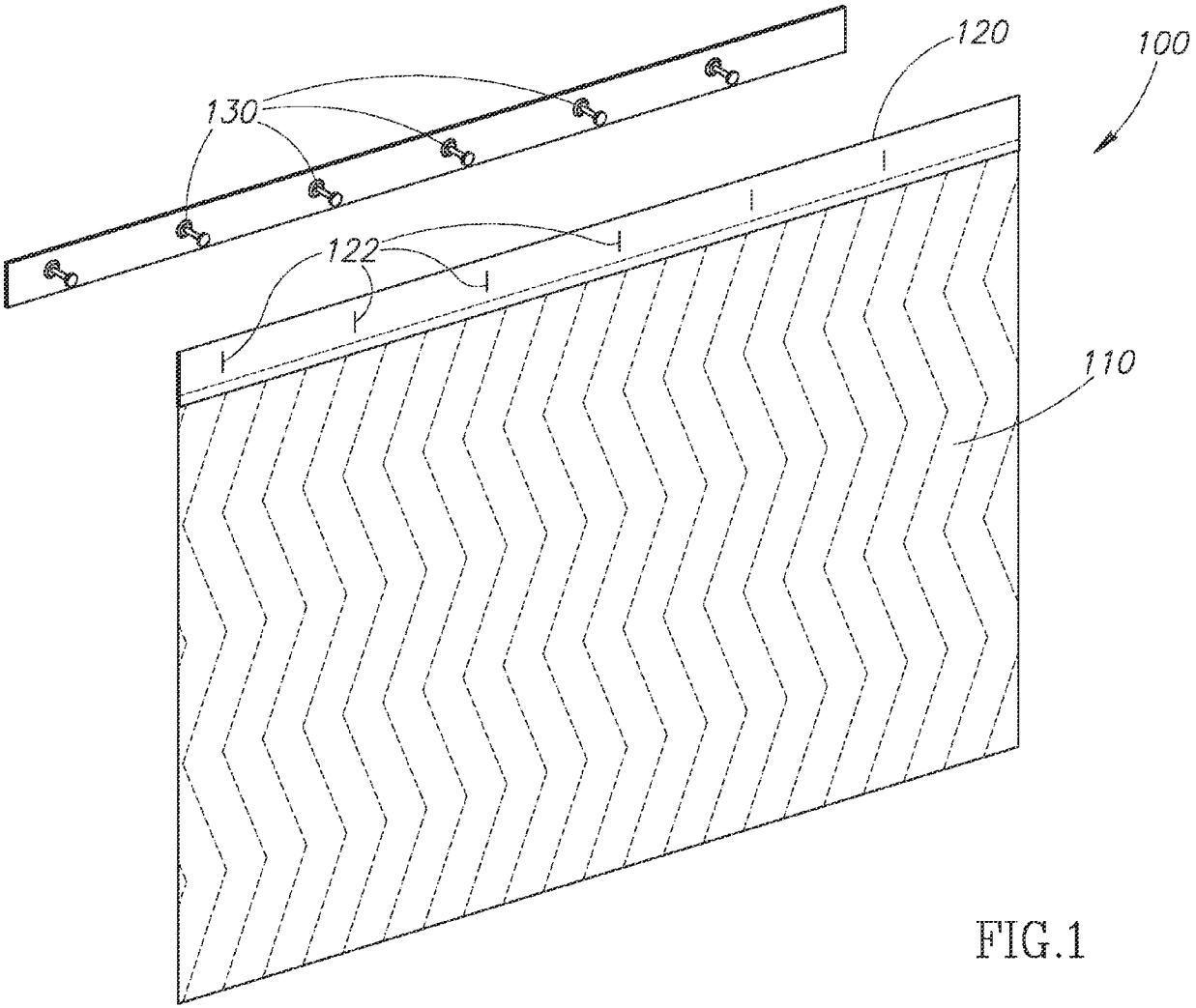
FIG. 1 is a schematic isometric depiction of a cover, trim, and knobs according to embodiments of the present disclosure.

FIG. 1 illustrates an elevator cover assembly 100 having a cover 110 and a trim 120. The cover 110 is a sheet of material with sufficient resiliency and padding to protect a surface, such as an interior surface of an elevator. The embodiments of the invention disclosed herein are specifically tailored to protect interior elevator walls. The cover 110 is preferably made of flexible fabric with padding sewn into the interior as is standard in the industry. The cover 110 can include rigid panels joined together with flexible fabric sections. The cover 110 is generally flexible enough to fit through the elevator door. The trim 120 is a strip of material positioned at an edge of the cover 110. The trim 120 is attached to the cover 110 by stitching or other suitable attachment means. The trim 120 has a plurality of openings 122 formed in the trim 120. In some embodiments, the trim 120 is made of a flexible material, such as a woven synthetic material like nylon, that is attached to the edge of the cover 110 with a portion of the trim 120 extending beyond the edge of the cover 110.

The trim 120 is formed as a separate piece from the cover 110 and is later attached to the cover 110. The trim 120 can be made in large quantities separate from the cover and can be cut to any length to fit any size of cover. The openings 122 can easily be formed in the trim 120 before the trim 120 is attached to the cover 110. In some embodiments the openings 122 are slits formed by passing a heated blade through the trim 120 at desired intervals. The heated blade also melt-fuses the cut synthetic material ends to bond them together such that they do not fray or tear. The openings 122 can also be holes, key-hole openings (e.g. combination slit and hole), crescent shape openings, etc. In other embodiments, the trim 120 can be initially formed to include the openings, such as by including a lower scalloped or jagged edge that will engage a knob to keep the cover in place.

The apparatus and methods of production of the present invention are very economical compared to conventional methods, such as cutting and sewing buttonholes in the cover itself. In some embodiments of the present invention, the trim 120 can be passed under a wheel having appropriately shaped blades at desired intervals such that the openings 122 are formed by simply moving the trim web under the blade wheel. As mentioned above, the blades can be heated to fuse the edges of the openings in the synthetic material that forms the trim to prevent fraying or tearing. In other embodiments the openings 122 can be formed using a radio frequency weld, which is also very cost-effective compared to conventional techniques.

The flexible nature of the trim 120 allows the trim 120 to be deformed to spread the openings 122 to insert the knob 130 into the slits. The spacing of the openings 122 is designed to correspond to the spacing of the knobs 130 for hanging. For example, the knobs 130 can be positioned in the interior of an elevator near the top of the walls. In preferred embodiments, the trim material is chosen such that it can withstand openings separated by very short intervals, such as approximately one inch between openings. Likely this spacing is more frequent than the knobs will be, but the high frequency makes the assembly able to fit a variety of knob configurations.

In some embodiments, the trim 120 is oriented generally horizontally and is positioned at a top of the cover 110. In other embodiments the trim 120 can be positioned vertically along a side edge of the cover 110. The cover assembly 100 can have multiple trims along multiple edges of the cover 110. For example, the cover 110 can have a trim 120 at the right and left-hand side of the cover 110 to engage with knobs 130 aligned vertically at a deployment site, or the cover 110 can have a trim 120 at all four edges of the cover 110. In still further embodiments, the trim 120 is positioned at an interior position on the cover 110 to provide still further engagement points. The number, spacing, and layout of the knobs 130 can vary as needed. For example, for embodiments in which the cover assembly 100 is to be used with very heavy-duty equipment, where the cover 110 itself is relatively heavy, the trim 120 and corresponding knobs 130 can be more numerous and placed closer together. In other circumstances in which the cover 110 is relatively light, the openings 122 and corresponding knobs 130 can be spaced further apart. The size of the individual openings 122 can also vary according to expected load. Another variable that may influence the size of the openings 122 is the aesthetic placement of the knobs 130 in the elevator or other location. For example, the openings 122 and knobs 130 may be aligned linearly at approximately the same level such that the load of the cover 100 when resting on the knobs 130 is distributed evenly on the openings 122. The openings 122 and knobs 130, however, may not always be aligned in a linear array, perhaps for functional or aesthetic reasons. The pattern of the openings 122 can match the pattern of the knobs 130. With enough slits in the trim, the alignment to various knobs that may not have the exact spacing of the slits can still be accommodated.

Figure 2:
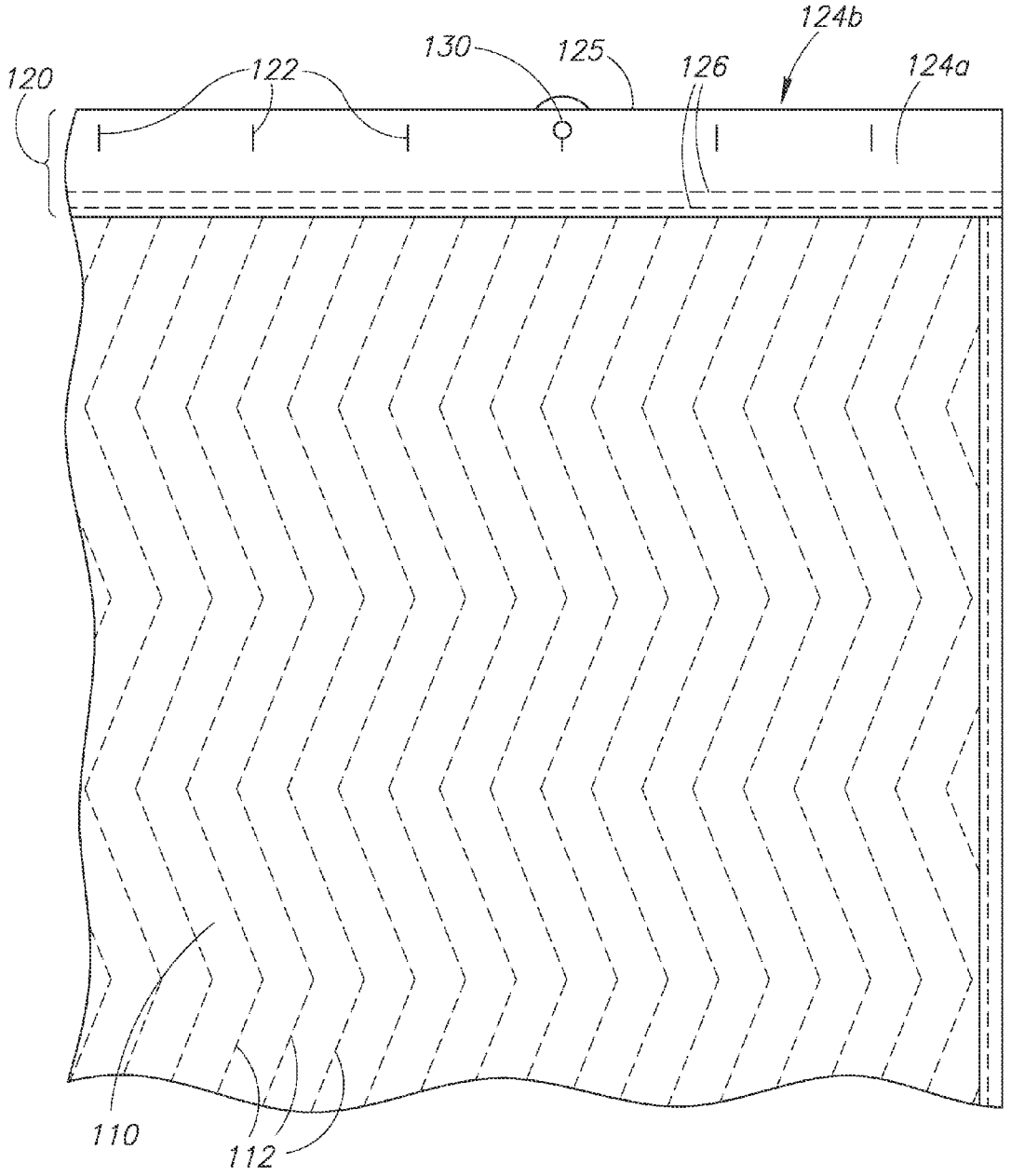
FIG. 2 is a front view of the cover assembly and a knob according to embodiments of the present disclosure.

FIG. 2 is a front view of the elevator cover assembly 100 with a single knob 130 coupled to the trim 120 according to embodiments of the present invention. The cover 110 has a herringbone stitching pattern 112 designed to improve padding capabilities. The trim 120 is a separate piece of material from the cover 110 that is then stitched to the cover 110 with two linear stitches 126. The trim 120 has a first side 124*a*, an upper edge 125 of the trim 120, a lower edge of the trim 120, and a second side 124*b* (on reverse side of trim 120; not visible in FIG. 2) opposite the first side 124*a*. As shown in FIG. 2, at least a portion of the cover 110 extends below each of the upper edge 125 and the lower edge of the trim 120. The trim 120 includes multiple openings 122 spaced throughout the trim 120. Also as shown in FIG. 2, the openings 122 are vertically between the upper edge 125 and the lower edge of the trim 120. The openings 122 can be made using a heated blade that melts the edges of the openings 122 to prevent fraying. Alternatively, the slits can be cut or otherwise formed in the trim 120 and then heated later to seal the edges against fraying. Since the trim 120 is a separate piece of material it can be made of a different material than the cover 110, which may not withstand so many slits at such small intervals without expensive reinforcement and or expensive cuts to make the openings. A conventional elevator pad is designed to withstand impacts, but not necessarily to support its own weight when perforated by several slits at small intervals. This drawback is avoided by the assembly 100 of the present disclosure.

A knob 130 is shown protruding through one of the openings 122. The trim 120 may have more openings 122 than the expected number of knobs 130 to provide compatibility with a number of different knob layouts. The material of the trim 120 and the cover 110 can be such that having extra openings 122 does not substantially weaken the cover assembly 100 and reduces the cost of manufacture by obviating the need to match certain slit configurations with various knob configurations. A building proprietor or service contractor therefore need not know the exact layout of the knobs in the elevator and potentially select a cover that does not fit the knobs. The high number and small interval of the slits provides a one-size-fits-all approach that reduces costs of manufacture and ownership.

Figure 3:
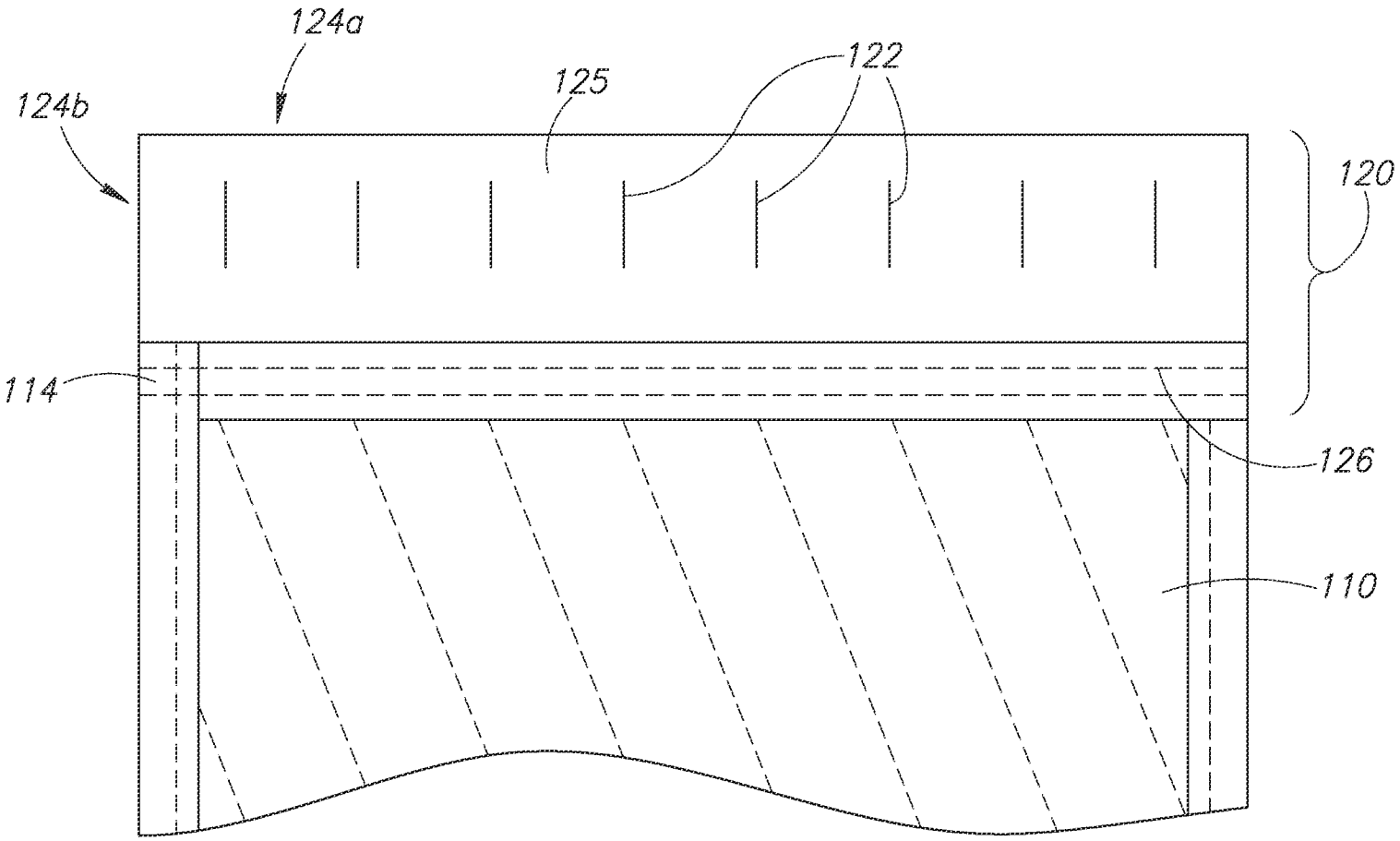
FIG. 3 is a rear view of the cover assembly of FIG. 2 according to embodiments of the present disclosure.

FIG. 3 is a rear view of the assembly 100 of FIG. 2 according to embodiments of the present disclosure. From this vantage point the upper edge 114 of the cover 110 is visible. The openings 122 in this embodiment does not pass through any portion of the cover 110; rather, they are confined to the material of the trim 120.

Figure 4:
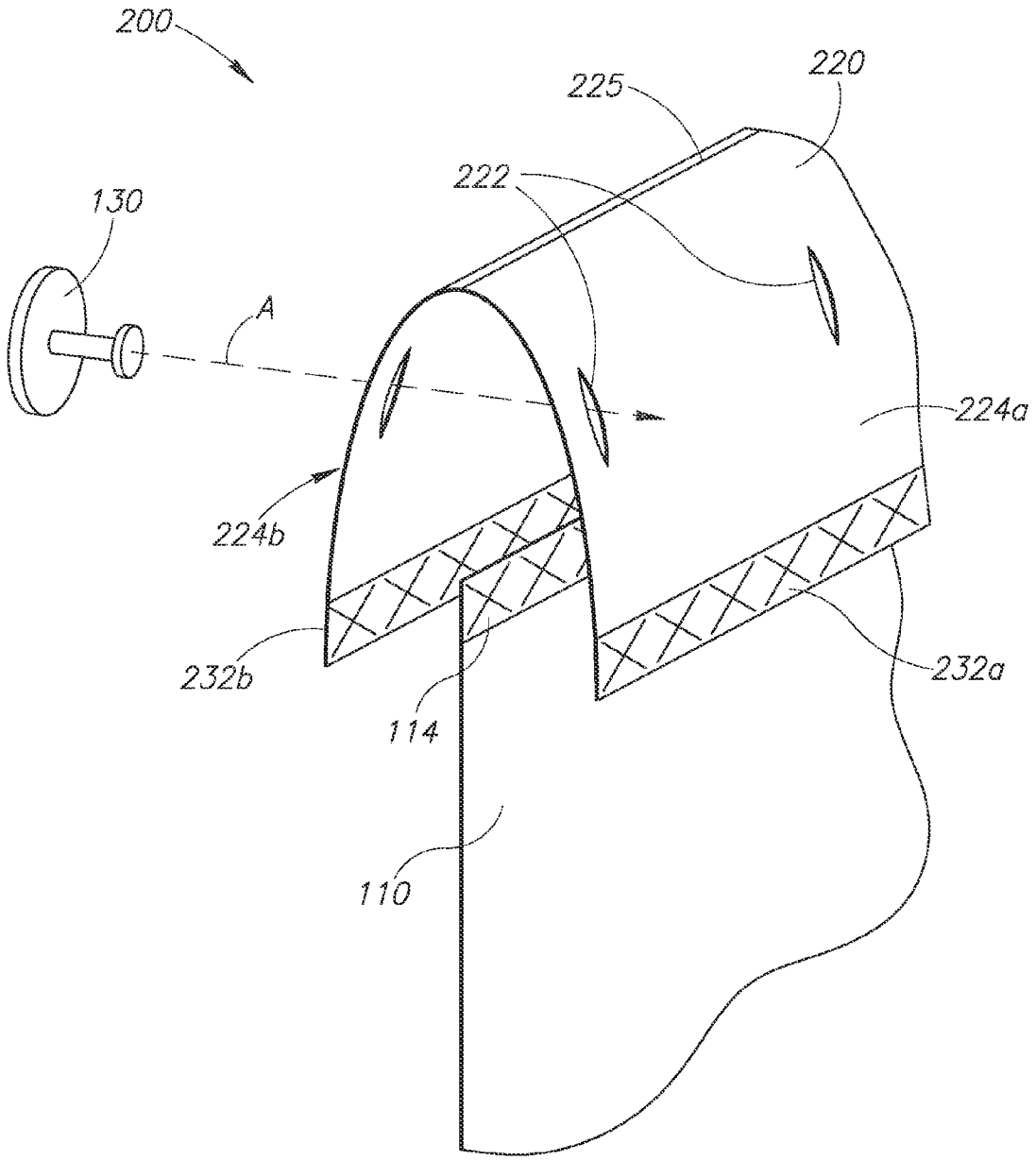
FIG. 4 is a schematic, isometric, exploded view of the elevator cover assembly according to another embodiment of the present disclosure.

FIG. 4 is a schematic, isometric, exploded view of an alternate embodiment of an elevator cover assembly 200. The assembly 200 includes a cover 110 having an edge 114 similar to previous embodiments. The edge 114 can be the top, bottom, or side edge of the cover 110. The assembly includes a trim 220 having a first side 224*a*, a second side 224*b*, and a fold 225 between the two sides. The first side 224*a* has a first trim edge 232*a*, and the second side has a second trim edge 232*b*. The first trim edge 232*a*, cover edge 114, and second trim edge 232*b* are stitched together to join the trim 220 to the cover 110. The trim 220 therefore extends beyond the cover edge 114 by a certain distance. As shown in FIG. 4, at least a portion of the cover 110 extends completely beyond the trim 220. The assembly also includes slits 222 formed in this portion of the trim 220 for coupling with a knob 130 via the slits 222 as shown by arrow A. The slits 222 can pass through one side of the folded trim 220 or through both sides of the folded trim 220 as shown in FIG. 4. In some embodiments, the slits 222 do not pass through the cover 110. Also as shown in FIG. 4, the slits 222 are between the first trim edge 232*a* and the second trim edge 232*b*. The amount of trim 220 protruding beyond the cover edge 114 depends on the size and layout of the slits 222. In other embodiments the cover edge 114 can extend all the way to the fold 225, and the slits 222 can be formed in the trim 220 as well as through the cover 110. In still further embodiments, the trim 220 can be a single sheet of material stitched to the cover 110 on one side, having no fold, and having slits 222 that engage the knobs 130. The trim 220 can be a long, continuous strip of material as shown in FIGS. 1-3, or it can be smaller, discrete fabric sections having slits 222 configured to engage knobs 130 to hold the cover assembly 200 in place. In still further embodiments, the slits 222 can be formed directly into the cover 110 and the trim 220 can be omitted partially or entirely.

Figure 5:
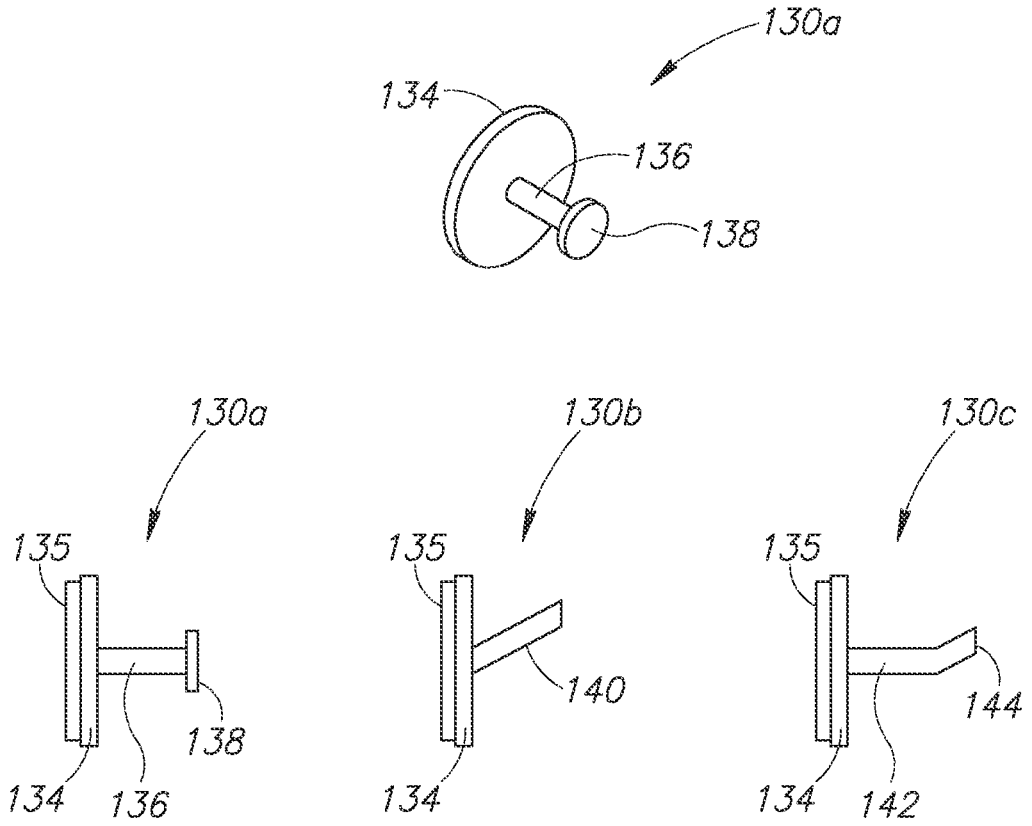
FIG. 5 illustrates various knob configurations according to the present disclosure.

FIG. 5 shows several knob configurations for use with the elevator cover assemblies disclosed herein. The knob 130*a* has a base 134, a stem 136, and a head 138 at an end of the stem 136. The head 138 can be slightly larger than the stem 136 to prevent the cover assembly 100 from falling off the knob 130. Base 134 preferably includes an quick-cure adhesive 135 on the backside thereof for easy application to a wall, including glass. The adhesive can be a high-strength adhesive such as a 3M's VHB 4941 acrylic adhesive tape that provides excellent adhesion to a broad range of high and medium surface energy substrates including metals, glass, and a wide variety of plastics and plasticized vinyl, even with mismatched substrates. The preferred adhesive tapes have very high tensile strength having a normal tensile strength of between 480-620 kPa, a 90° peel adhesion strength of between 245-385 N/100 mm, and a dynamic overlap sheer strength of between 450-620 kPa. Use of an adhesive allows the knob to be attached to the wall without intrusive and expensive penetration of the wall such as by drilling or puncturing. In other embodiments, the base 134 includes another attachment mechanism, such as a threaded fastener or the like. Other than the adhesive layer, the knob 130*a* can be a unitary piece of material or can be a base 134 welded to a stem 136 and a head 138 welded to the stem 136. It may be formed by machining or otherwise forming from a single piece of material, preferably metal.

Another embodiment is knob 130*b*, which has a base 134 and an upwardly angled stem 140. The upward slope keeps the cover assembly 100 from slipping off the knob 130*b* and therefore obviates the need for a head. The slope and length of the knob 130*b* can vary as needed for a particular installation. Another embodiment is knob 130*c*, which includes a base 134, a horizontally extending stem portion 142, and an upwardly extending portion 144 that functions similarly to the head 138 to prevent the cover assembly 100 from slipping off the knob 130*c*. In any of these embodiments, the base 134 can be omitted in favor of a simple stem and head combination extending from the wall of the elevator. In some embodiments, the knob can include a base having multiple projections extending therefrom. Virtually any configuration of knob can be used with the elevator cover assembly of the present disclosure.

Figure 6:
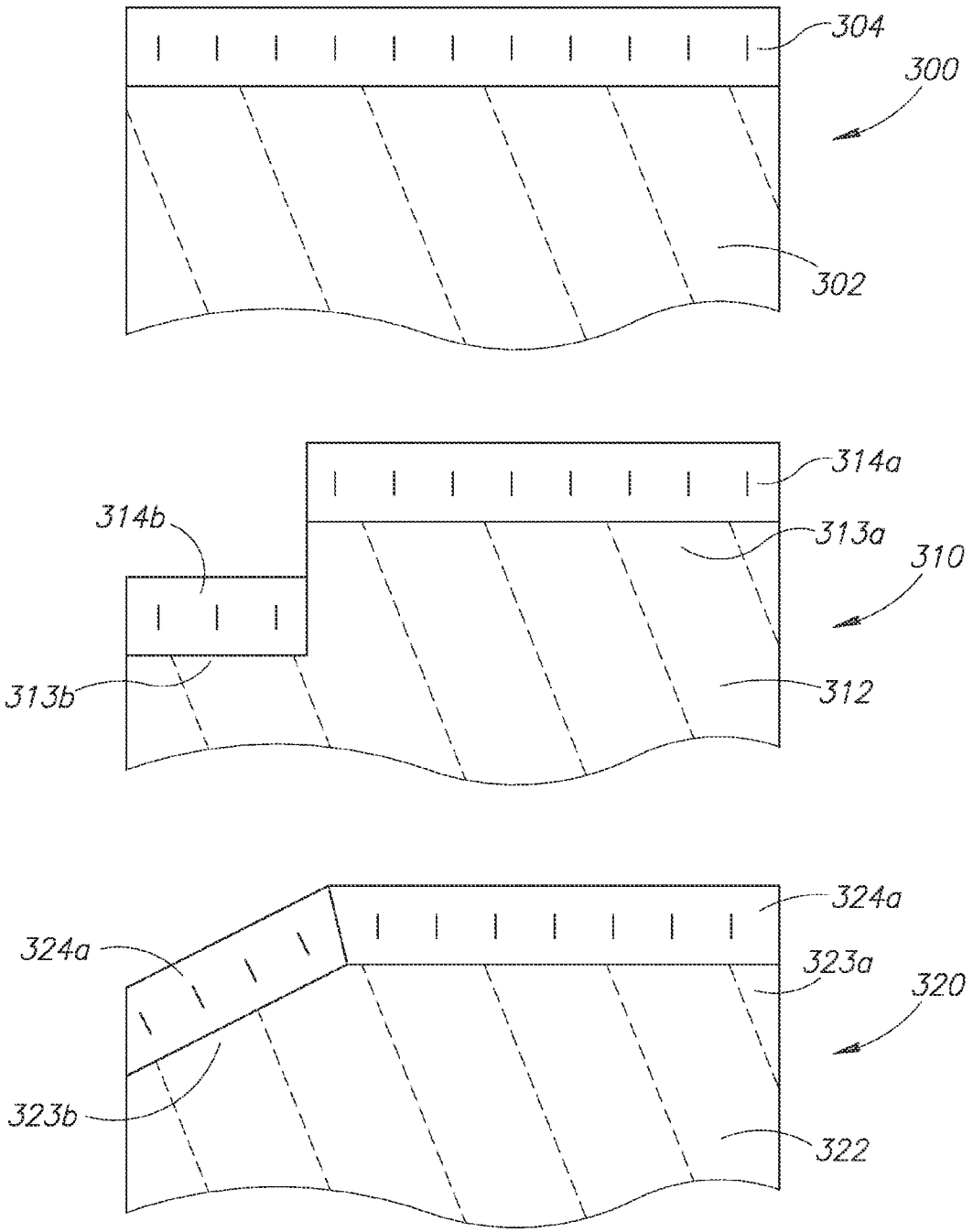
FIG. 6 illustrates cover assemblies according to embodiments of the present disclosure including a flat, stepped, and angled profile.

FIG. 6 shows three cover pad assemblies according to embodiments of the present disclosure. The first assembly 300 includes a flat cover 302 and a linear trim 304. This type of assembly will fit most elevator installations with flat ceilings without complex light fixtures that impede the cover in some way. The cover 302 can include cut outs to accommodate emergency lights or other ceiling structures. As described above, the cover 302 and trim 304 are separate and are joined by stitching, welding, fusing, or another suitable material joining technique.

The second assembly 310 includes a cover 312 having a stepped top. A first portion 313*a* is longer than a second portion 313*b*. The assembly 310 includes a two-part trim with a first trim portion 314*a* and a second trim portion 314*b* attached to the first portion 313*a* and second portion 313*b*, respectively. The cover can have any number of different regions at different elevations to accommodate virtually any ceiling profile. The trim portions 314*a*, 314*b* can be separate strips each attached to the corresponding region of the cover independently. Constructing the separate trim strips is a simple matter of cutting the strip material to match the width of the portion to which it corresponds. Attaching the separate trim portions to the cover is also a simple matter, requiring only that the trim be sewn to the right cover region. This construction is much simpler and less expensive to manufacture than other designs in which the attachment slits are constructed directly into the cover itself with no separate material for the trim.

The third assembly 320 includes a cover 322 having a first region 323*a* that is flat and a second region 323*b* that is angled. The trim includes corresponding regions 324*a* and 324*b*. The angle of the second region 323*b* and trim portion 324*b* can take any appropriate angle as needed for a given elevator assembly. Other profile shapes are also possible, including curved and jagged profiles. By virtue of the trim being a separate material from the cover, the trim assemblies shown in FIG. 6 are much more easily constructed, yet are more durable than conventional cover assemblies.

While the preferred embodiments of the invention have been illustrated and described, as noted above, many changes can be made without departing from the spirit and scope of the invention. Accordingly, the scope of the invention is not limited by the disclosure of the preferred embodiments. Instead, the invention should be determined entirely by reference to the claims that follow.

The embodiments of the invention in which an exclusive property or privilege is claimed are defined as follows:

1. An elevator cover assembly for hanging from a projection in an elevator, the assembly comprising:

a cover that includes a substantially flat, protective, and flexible sheet of material having sufficient thickness and rigidity to protect an interior surface of the elevator;

a trim formed from a strip of material that is separate from the sheet of material of the cover and attached to an upper edge of the cover, the trim having a first edge and a second edge, wherein the first edge of the trim is attached to the upper edge of the cover and the second edge of the trim extends beyond the edge of the cover such that at least a portion of the cover extends below each of the first edge and the second edge of the trim; and a plurality of openings formed in the trim and configured to receive the projection from the elevator to hang the cover assembly within the elevator, wherein the second edge of the trim extends beyond the edge of the cover a sufficient distance such that each of the plurality of openings is positioned on the trim beyond the upper edge of the cover and between the first edge and the second edge of the trim.

2. The elevator cover assembly of claim 1, wherein one or more of the plurality of openings are at least one of a slit, a hole, a key-hole opening including a slit portion and a hole portion, or a crescent shape opening.

3. The elevator cover assembly of claim 1, wherein the trim is formed from a flexible strip of material such that deforming the trim at the openings causes them to more widely open.

4. The elevator cover assembly of claim 1, wherein the openings are formed by cutting through the trim.

5. The elevator cover assembly of claim 1, wherein the openings are formed by hot-cut melting through a portion of the trim.

6. The elevator cover assembly of claim 1, wherein the trim is attached to the upper edge of the cover by one or more stitches.

7. The elevator cover assembly of claim 1, wherein the openings are aligned with the upper edge of the cover.

8. The elevator cover assembly of claim 1, wherein the cover is substantially coextensive with a wall of the elevator.

9. The elevator cover assembly of claim 1, wherein the trim is formed from a woven synthetic strip of material.

10. The elevator cover assembly of claim 1, wherein at least one of the plurality of openings is configured to receive a projection having a base and a stem protruding from the base, wherein the base provides a stable support for the stem and is securable to a wall with a quick-curing permanent adhesive.

11. The elevator cover assembly of claim 10, wherein the projection further includes a head coupled to the stem, wherein the head is slightly larger than the stem to maintain the elevator cover assembly on the projection.

12. The elevator cover assembly of claim 1, the trim further includes a fold between the first edge of the trim and the second edge of the trim, wherein the fold is formed by folding the trim over the upper edge of the cover with the first and second edges of the trim contacting a first side and a second side of the cover with the first edge and the second edge of the trim being substantially aligned and stitched together through the upper edge of the cover, and wherein each of the plurality of openings is positioned on the trim and between the first edge of the trim and the fold.

13. The elevator cover assembly of claim 1, wherein the upper edge of the cover has an irregular profile, including at least one of a flat, stepped, curved, or angled portion, the assembly further comprising separate trim portions corresponding to the flat, stepped, curved, or angled portion.

* * * * *